US007467907B2

(12) United States Patent
Gaynes et al.

(10) Patent No.: US 7,467,907 B2
(45) Date of Patent: Dec. 23, 2008

(54) VALVE MECHANISMS FOR PAINT OR INK BRUSH WITH INTEGRATED RESERVOIR

(75) Inventors: Steven Gaynes, Wonderlake, IL (US); Leighton Davies-Smith, Oswego, IL (US); Howard Danzyger, South Elgin, IL (US); Michael Flader, Vernon Hills, IL (US); Jason Cantu, Vernon Hills, IL (US)

(73) Assignee: Sanford, L.P., Oak Brook, IL (US)

( * ) Notice: Subject to any disclaimer, the term of this patent is extended or adjusted under 35 U.S.C. 154(b) by 520 days.

(21) Appl. No.: 10/896,560

(22) Filed: Jul. 22, 2004

(65) Prior Publication Data

US 2005/0042019 A1 Feb. 24, 2005

Related U.S. Application Data

(60) Provisional application No. 60/496,300, filed on Aug. 19, 2003.

(51) Int. Cl.
*B43M 11/06* (2006.01)

(52) U.S. Cl. ..... 401/186; 401/273; 401/206

(58) Field of Classification Search ..... 401/186, 401/205, 206, 219, 263, 270, 273, 278
See application file for complete search history.

(56) References Cited

U.S. PATENT DOCUMENTS

| | | | | |
|---|---|---|---|---|
| 113,305 | A | 4/1871 | Kellogg | |
| 469,990 | A | 3/1892 | Brewington | |
| 753,593 | A | 3/1904 | Langill | |
| 907,850 | A | 12/1908 | Mountford | |
| 1,028,011 | A * | 5/1912 | Ferenczy | 401/270 |
| 1,526,093 | A | 2/1925 | Rockman | |
| 1,621,432 | A | 3/1927 | Rockman | |
| 1,693,330 | A | 11/1928 | Astley | |
| 1,694,306 | A | 12/1928 | Astley | |
| 1,935,639 | A | 11/1933 | Keeshan | |
| D108,577 | S | 2/1938 | Mureau | |
| D175,548 | S | 9/1955 | Kane | |

(Continued)

FOREIGN PATENT DOCUMENTS

| | | |
|---|---|---|
| FR | 1.016.052 | 10/1952 |

(Continued)

OTHER PUBLICATIONS

International Search Report for PCT/US2004/025877 dated Dec. 29, 2004 (8 pages).

(Continued)

*Primary Examiner*—Huyen Le
(74) *Attorney, Agent, or Firm*—Marshall, Gerstein & Borun LLP

(57) ABSTRACT

An improved fluid control system for a paint brush or applicator system that includes a flexible barrel-type reservoir is disclosed. The disclosed valve systems may be of a ball-valve type, a trumpet-type or a duck-bill type. The valve or control systems help the user regulate the flow of fluid from a flexible barrel reservoir to a brush or applicator tip by adequately restricting flow in response to squeezing pressure applied by the user to the flexible barrel reservoir.

26 Claims, 7 Drawing Sheets

U.S. PATENT DOCUMENTS

| | | | | | |
|---|---|---|---|---|---|
| 2,783,488 | A | * | 3/1957 | Jockers | 401/206 |
| 3,061,868 | A | | 11/1962 | Miller | |
| 3,468,611 | A | | 9/1969 | Ward | |
| 3,565,540 | A | | 2/1971 | Andrews | |
| 4,117,957 | A | * | 10/1978 | Duffey | 222/321.2 |
| D260,406 | S | | 8/1981 | Itoh | |
| 4,364,684 | A | * | 12/1982 | Kohno et al. | 401/264 |
| D271,212 | S | | 11/1983 | Itoh | |
| 4,534,669 | A | * | 8/1985 | Heck et al. | 401/134 |
| 4,588,319 | A | | 5/1986 | Niemeyer | |
| 4,671,692 | A | | 6/1987 | Inaba | |
| 4,792,252 | A | | 12/1988 | Kremer et al. | |
| 4,913,175 | A | | 4/1990 | Yokosuka et al. | |
| 4,970,854 | A | | 11/1990 | Komiya et al. | |
| 4,997,301 | A | | 3/1991 | Sheu | |
| 5,092,702 | A | | 3/1992 | Kurokawa | |
| 5,169,467 | A | | 12/1992 | Komiya et al. | |
| 5,279,499 | A | | 1/1994 | Carter | |
| 5,290,116 | A | | 3/1994 | Chang | |
| D363,307 | S | | 10/1995 | Shikuwa | |
| 5,607,766 | A | | 3/1997 | Berger | |
| 5,727,893 | A | | 3/1998 | Handler | |
| 5,927,885 | A | | 7/1999 | Duez et al. | |
| 5,971,646 | A | | 10/1999 | Chavatte et al. | |
| 6,210,063 | B1 | | 4/2001 | Isobe et al. | |
| 6,227,741 | B1 | | 5/2001 | Quercioli | |
| 6,322,269 | B1 | | 11/2001 | Witz et al. | |
| D454,158 | S | | 3/2002 | Takanashi | |
| 6,386,781 | B1 | | 5/2002 | Gueret | |
| 6,488,429 | B2 | | 12/2002 | Korper | |
| 6,503,015 | B1 | | 1/2003 | Bianco, Jr. | |
| 6,572,297 | B2 | | 6/2003 | Korper | |
| 6,669,390 | B1 | * | 12/2003 | Porter et al. | 401/186 |
| 2002/0025214 | A1 | | 2/2002 | Korper | |
| 2002/0054783 | A1 | | 5/2002 | Gueret | |
| 2002/0168215 | A1 | | 11/2002 | Witz et al. | |
| 2002/0186997 | A1 | | 12/2002 | Kim | |
| 2002/0192010 | A1 | | 12/2002 | Korper | |
| 2003/0031501 | A1 | | 2/2003 | Eadie | |
| 2003/0152411 | A1 | | 8/2003 | Prokopos | |

FOREIGN PATENT DOCUMENTS

| | | | |
|---|---|---|---|
| JP | 10272883 | A | 10/1998 |
| JP | 2001-279153 | A | 10/2001 |
| WO | WO 99/28046 | | 6/1999 |
| WO | WO 02/100658 | A1 | 12/2002 |

OTHER PUBLICATIONS

Written Opinion of the International Searching Authority for PCT/US2004/025877 dated Dec. 29, 2004 (6 pages).

* cited by examiner

VALVE MECHANISMS FOR PAINT OR INK BRUSH WITH INTEGRATED RESERVOIR

CROSS-REFERENCE TO RELATED APPLICATION

This application claims the benefit under 35 U.S.C. § 119 (e) of U.S. Provisional Patent Application Ser. No. 60/496,300, filed Aug. 19, 2003, the disclosure of which is incorporated herein by reference.

BACKGROUND

1. Technical Field

A liquid applicator with an integrated fluid (i.e., paint) reservoir is disclosed. In an embodiment, a paint or ink brush is disclosed which includes a control valve system between a liquid reservoir and the brush or applicator tip is disclosed. Paint, ink or other fluids are transmitted from the reservoir by squeezing the flexible barrel that defines the reservoir. The fluid then flows towards the brush or applicator tip by first flowing through one of the disclosed control valve mechanisms.

2. Background of the Related Art

When painting or using ink brushes, artists typically use numerous brushes in combination with a pallet upon which a variety of paint colors is disposed. While this system has been utilized for centuries, there is a current demand for paint brushes that include a paint reservoir connected to the brush thereby eliminating the need for a separate pallet. Such a device would be particularly advantageous in the area of water color painting due to the relatively low viscosity of water color paints after they have been dissolved in water.

However, control of the paint or ink to the brush remains a problem. A reliable fluid control system is needed that provides the artist with a requisite control of the water color through the brush. Thus, an improved fluid control system for this specific purpose is needed. Also, fluid control system is needed that allows the proper amount of ink to flow without allowing ink to "gush" from the brush in the event a child or inexperienced user squeezes the reservoir with excessive force.

It is also anticipated that such an improved fluid control system could be used in other areas where fluid is stored in a reservoir that is coupled to a brush, applicator tip or other type of applicator. Controlling the flow rate of fluid from the reservoir to the brush or applicator is essential because an insufficient flow will leave the user frustrated and wanting to return to prior art systems where the brush is simply dunked in a jar or container of material to be applied to the work piece or the use of a separate pallet. Similarly, excess flow through the brush tip may damage the end product or work piece, thereby also leading to frustration on the part of the user.

Therefore, there is a need for improved fluid control system for instruments which combine a reservoir and brush or applicator which will facilitate the desired flow rate of fluid from the reservoir to the brush or applicator.

SUMMARY OF THE DISCLOSURE

In satisfaction of the aforenoted needs, improved mechanical valve systems are disclosed which are to be placed between a flexible barrel reservoir and a brush or applicator tip.

In an embodiment, a liquid applicator is disclosed which comprises a flexible reservoir for accommodating liquid. The reservoir includes an open end that is connected to a ferrule with a valve assembly disposed therebetween. The valve assembly comprises a collar comprising a proximal end facing the reservoir and a distal end facing the ferrule. The collar comprises a stepped passageway extending therethrough that provides communication between the reservoir and the ferrule. The step passageway has a narrow middle portion between proximal and distal ends of the collar. The proximal end of the collar receives a valve member and a retainer with the valve member trapped between the retainer and the narrow middle portion of the collar.

In a refinement, the distal end of the collar receives a pin seal. The pin seal comprises a shaft having a solid proximal end directed towards the reservoir and a distal end directed towards the ferrule. The distal end of the shaft of the pin seal includes an axial slot. The pin seal is movable between a closed position with the proximal end of the shaft being disposed in the middle portion of the collar and blocking flow therethrough and an open position where at least a portion of the axial slot of the shaft is disposed in the middle portion of the collar passageway thereby permitting restricted flow therethrough.

In an embodiment, the valve assembly is a ball valve assembly. In another embodiment, the valve assembly is a trumpet valve assembly. In yet another embodiment, the valve assembly comprises a permeable body such as a fiber plug or a foam plug which permits restricted flow of fluid through the collar.

In the embodiments with a ball valve assembly or a trumpet vale assembly, the valve member, such as a ball or trumpet valve member may be biased against the seat or retainer by a spring.

In another refinement, the distal end of the shaft of the pin seals connected to a flange which is accommodated in the distal end of the collar. Preferably, the flange also includes a slot in alignment with the axial slot of the distal end of the shaft of the pin seal.

In certain embodiments, a restrictor element may be disposed between the ferrule and the distal end of the collar or, more specifically, the restrictor element may be disposed between the tufted brush element and the distal end of the collar.

The above designs are applicable to liquid applicators using a brush or tufted applicator element. The above liquid applicators are particularly applicable to paint and ink brushes, but other uses will be apparent to those skilled in the art.

In a more specific embodiment, a ball valve is disposed between a flexible barrel reservoir and a tufted brush or applicator. The ball valve comprises a retainer or seat having a proximal side facing the barrel reservoir and a distal side for receiving a ball. A spring may be employed to bias the ball into engagement with the seat. If such a spring is used, the spring and ball are sandwiched between the seat and a collar. The ball, optional spring and seat are all disposed within a collar that is disposed between the barrel reservoir and the brush or applicator tip. A pin seal is placed into the end of the collar that faces the brush. When the user squeezes the flexible barrel reservoir, pressure is generated therein and transferred through the annular valve seat to the ball. The pressure on the ball moves the ball in a distal direction away from the reservoir towards the brush or applicator tip. Fluid may then migrate through the valve seat and past the ball. When excessive force is applied, the ball will seat against an inside wall of the collar and prevent paint from gushing from the brush.

The pin seal is disposed within the collar and provides the requisite resistance to the fluid flowing past the ball and through the collar, past the pin seal. The pin seal may include a flange portion concentrically connected to a shaft portion. The shaft portion faces the proximal direction or towards the ball and barrel reservoir.

Again, both the shaft and flange portions of the pin seal may include slots or recesses to permit sufficient flow past the pin seal towards the brush or applicator tip.

In a refinement, the pin seal is provided in an initially closed position to ensure that no fluid may pass from the reservoir through the valve before the pin seal is unseated.

In a refinement, a restrictor can be eliminated and the paint flow restricted by the opening in the collar.

In a refinement the spring or biasing element is not present. The ball oscillates between a closed and open position based upon the pressure in the barrel reservoir. The pressure increase generated by squeezing the reservoir or the drop generated by releasing the reservoir controls the flow of ink and prevents gushing.

In an alternative embodiment, a flared needle or trumpet valve may be utilized instead of a ball valve. The needle or trumpet valve includes a flared end received within a corresponding portion of the collar. A flanged proximal end of the valve is disposed within the reservoir and a spring disposed between the flanged proximal end and the collar biases the valve into a closed position. Pressure within the reservoir generated by the user causes the valve to move in a distal direction against the bias of the spring to permit flow through the collar. A pin seal, similar but not necessarily identical to the pin seal described above further controls fluid flow through the collar to the applicator or brush or through the collar, through the restrictor and onto the applicator or brush.

In another refinement, a duck-bill valve is provided in the barrel reservoir to permit air into the reservoir to replace the displaced fluid, which may be paint, water color paint, ink, correction fluid or other similar fluids applied to various surfaces through a brush or applicator tip.

In yet another embodiment, a duck-bill valve is utilized instead of the ball valve or needle/trumpet valve systems discussed above.

BRIEF DESCRIPTION OF THE DRAWINGS

The disclosed embodiments are described more or less diagrammatically in the accompanied drawings, wherein.

It should be understood that the drawings are not necessarily the scale and that the embodiments are sometimes illustrated by graphic symbols, phantom lines, diagrammatic representations and fragmentary views. In certain instances, details which are not necessary for an understanding of the disclosed embodiments or which render other details difficult to perceive may have been omitted. It should be understood, of course, that this disclosure is not limited to the particular embodiments illustrated herein.

DETAILED DESCRIPTION OF THE PRESENTLY PREFERRED EMBODIMENTS

Figure 1:
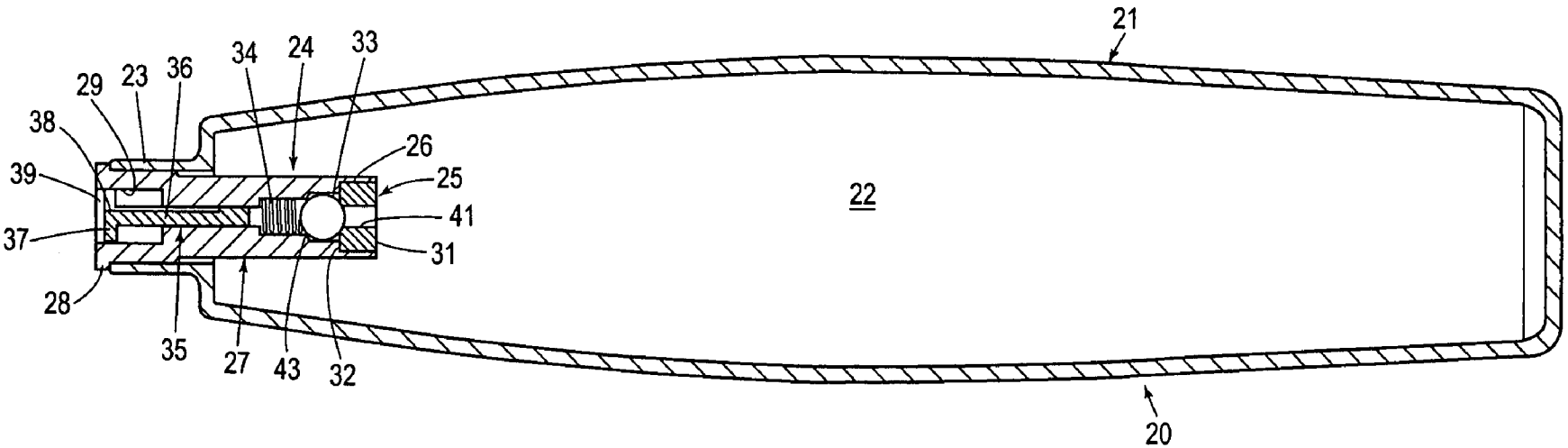
FIG. 1 is a partial sectional view of a fluid dispensing instrument made in accordance with this disclosure, particularly illustrating a flexible barrel reservoir and ball valve system for transmitting fluid from the barrel reservoir out through the valve system and wherein the valve is in a closed position.

Turning to FIG. 1, a partial view of a fluid dispensing instrument 20 is shown which includes a flexible barrel reservoir 21 defining a reservoir space 22 and having a distal end 23 that forms a collar for receiving a ball valve assembly shown at 24.

The ball valve assembly 24 includes a retainer or valve seat 25 received within a proximal end 26 of a collar 27. The collar 27 also includes a flanged distal end 28 which is received within the collar 23 of the barrel 21 and which also includes stepped central opening 29 that extends through the collar 27 with varying diameters.

The retainer or valve seat 25 includes a proximal end 31 that faces the reservoir 22 and a distal end 32 which engages the ball 33. The spring 34, which is optional, biases the ball 33 against the distal end or seat portion 32 of the valve seat 25. The spring 34, ball 33 and valve seat 25 are all received within the stepped passage way 29 of the collar 27. Also received within this stepped passageway 29 is a pin seal element shown at 35. The pin seal 35 includes a shaft 36 connected to a distal flange 37. Both the shaft 36 and flange 37 include recesses shown at 38, 39 respectively which facilitate and restrict the passage of fluid from the reservoir 22 and through the valve system 24 to a brush or applicator tip (not shown).

In the position shown in FIG. 1, the ball valve assembly 24 is in an open position with the ball 33 moving slightly off of the ball seat 25 and overcoming the bias of the spring 34. This action is caused by pressure within the reservoir 22 which is generated by the user squeezing the barrel structure 21. This internal pressure generates fluid flow through the central opening 41 of the valve seat 25, pushing the ball 33 off of the distal end 32 of the valve seat 25, thereby overcoming the bias of the spring 34. The spring 34 is optional and pressure from within the reservoir 22 generated by squeezing the barrel 21 can also be used to move the ball off the seat 25. Fluid then enters through the valve seat 25 and stepped passageway 29.

Figure 2:
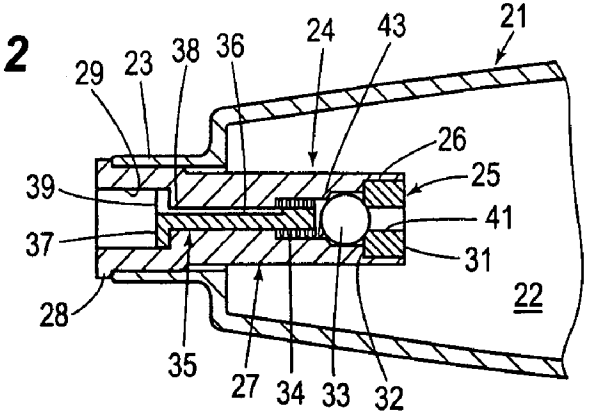
FIG. 2 is a partial sectional view of the instrument shown in FIG. 1 illustrating the ball valve in an open position.

To permit fluid to flow past the pin seal 35 and to the applicator or brush (not shown) the pin seal 35 is moved from the closed position shown in FIG. 1 whereby the shaft 36 has sealed the passageway 29 to the open position shown in FIG. 2 where the slot 38 and clearance between the shaft 36 and collar 37 permit the communication of fluid through the passageway 29 and past the shaft 36. Excessive pressure in the reservoir 22 will cause the pin seal 35 to assume the closed position shown in 35. If this happens, the pin seal 35 can be re-set to the open position shown in FIG. 2. Also, when excessive pressure is applied or generated, the ball 33 seats against the stepped portion 43 of the collar 27. This action prevents excessive flow or gushing of paint through the collar 27.

The spring 34 is optional as ball 33 has a tendency to "re-seat" itself against the valve seat 25 when pressure in the reservoir area 22 is released. In the open position as shown in FIG. 2, movement of fluid past the flange 37 and shaft 36 of the pin seal 35 is facilitated by the slots or grooves shown at 38, 39.

Figure 3:
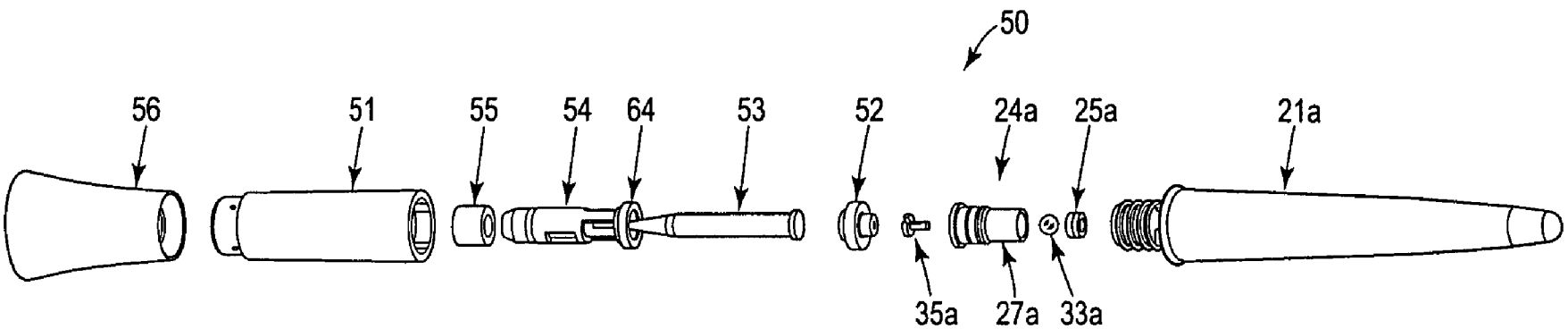
FIG. 3 is an exploded view of a preferred fluid application instrument made in accordance with this disclosure.

A brush applicator instrument 50 is shown in FIG. 3 with a further refinement of the ball valve assembly shown at 24*a*. Specifically, the instrument 50 includes a flexible barrel reservoir 21*a* that is threadably connected to a ferrule 51 with the ball valve assembly 24*a*, restrictor or pilot 52, brush or applicator 53, support or holder 54 and a buffer 55 that may be made of foam or a fibrous material. The spring 34 has been eliminated. A top or cap is shown at 56. Details of the ball valve assembly 24*a* are provided in FIGS. 4-15.

Figure 4:
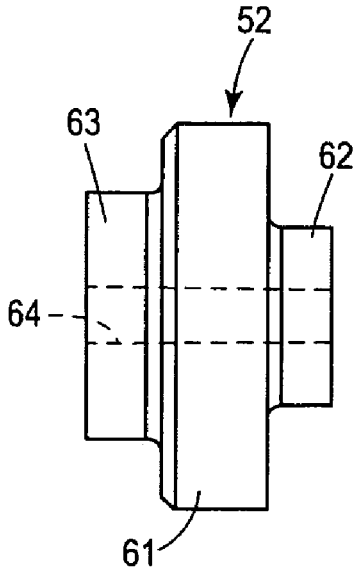
FIG. 4 is a side plan view of the pilot or restrictor element of the assembly shown in FIG. 3.
Figure 5:
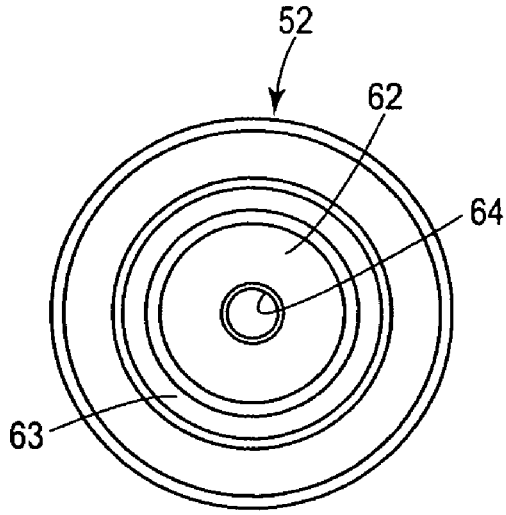
FIG. 5 is an end view of the pilot or restrictor shown in FIG. 4.
Figure 6:
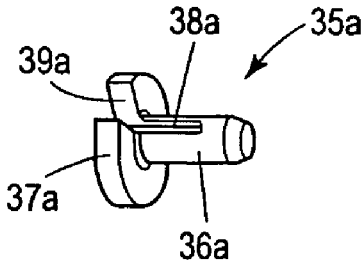
FIG. 6 is a perspective view of the pin seal element of the instrument shown in FIG. 3.
Figure 7:
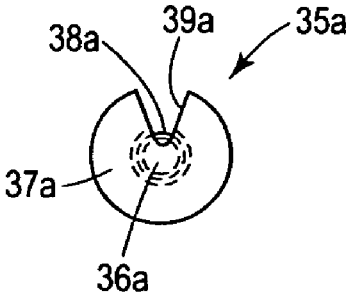
FIG. 7 is a left end view of the pin seal element shown in FIG. 6.
Figure 8:
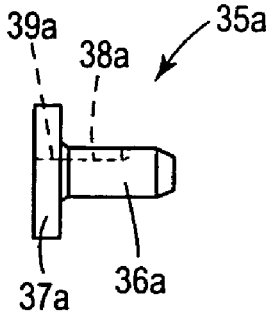
FIG. 8 is a side plan view of the pin seal element shown in FIG. 6.
Figure 9:
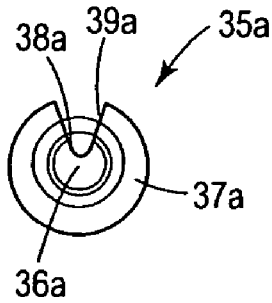
FIG. 9 is a right end view of the pin seal element shown in FIG. 6.

At the outset, a pilot or restrictor element is shown at 52 in FIGS. 4-5. The restrictor 52 includes a central flange 61 disposed between a smaller proximal annular portion 62 that is received within the distal end 28*a* of the collar 27*a* (see FIGS. 12-13) and a larger distal annular portion 63 that is received within the proximal end 64 of the holder 54 (see FIG. 3). The central passageway 64 extends through the restrictor 52.

Turning to FIGS. 6-9, the pin seal element 35*a* is shown in greater detail. Specifically, the pin seal 35*a* includes a shaft 36*a* that is connected to a distal flange 37*a*. A v-shaped slot 38*a* extends at least partially through the shaft 36*a* and to the v-shaped slot 39*a* that extends at least partially through the flange 37*a* as shown in FIGS. 6-9. The slots 38*a*, 39*a* facilitate fluid flow in the distal direction, or between the barrel reservoir 21*a* and the brush or applicator tip 53.

Figure 10:
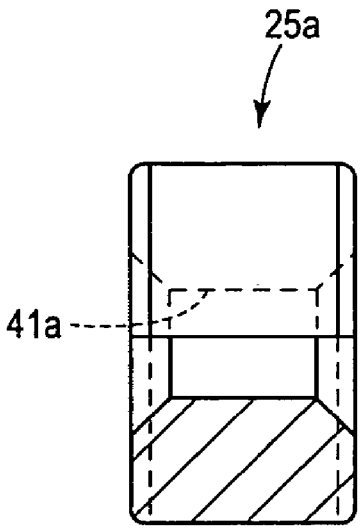
FIG. 10 is a side sectional view of the retainer or valve seat of the instrument shown in FIG. 3.
Figure 11:
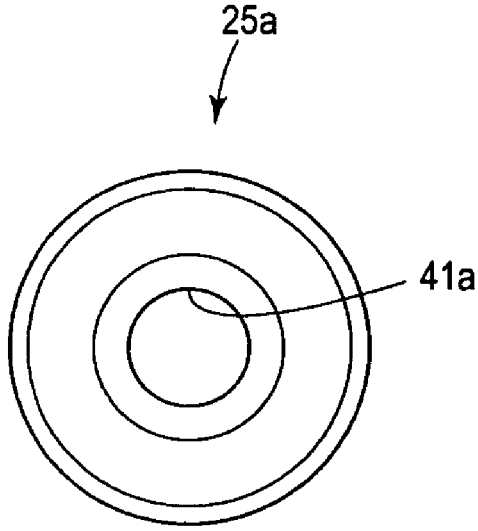
FIG. 11 is a side plan view of the retainer or valve seat shown in FIG. 10.
Figure 12:
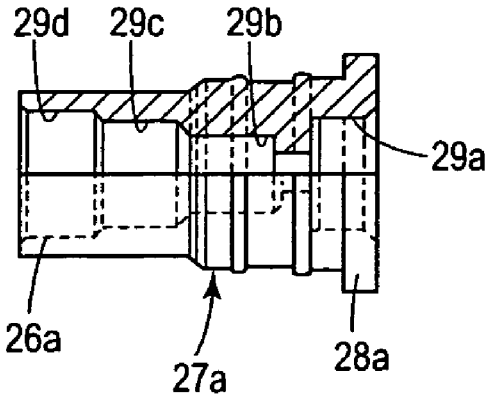
FIG. 12 is a side view of the valve collar of the instrument shown in FIG. 3.
Figure 13:
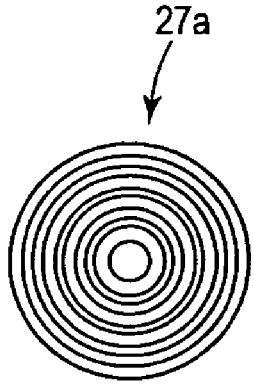
FIG. 13 is an end view of the valve collar shown in FIG. 12.
Figure 14:
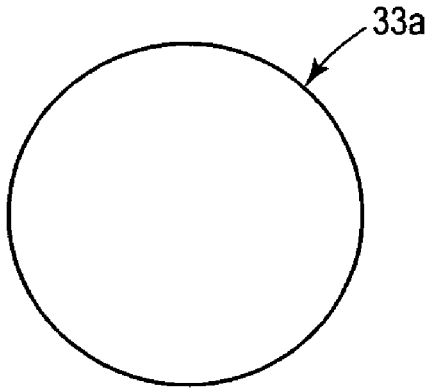
FIG. 14 is a plan view of the ball or spherical valve of the instrument shown in FIG. 3.
Figure 15:
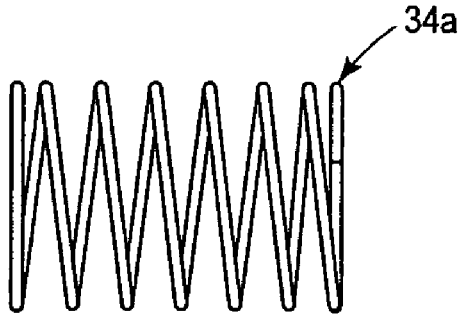
FIG. 15 is a side plan view of the optional spring of the ball valve system of the instrument shown in FIG. 3.

Turning to FIGS. 10-11, the seat or retainer 25*a* is shown in greater detail. The seat 25*a* includes a central passageway 41*a* for the passage of fluid through the ball valve assembly 24*a*. The seat 25*a* is received within the proximal end 26*a* of the collar 27*a* as shown in FIG. 12. Still referring to FIG. 12, portions of the stepped passageway that extend through the collar 27*a* may be broken down as follows: the portion 29*a* which receives the annular portion 62 of the restrictor 52; the portion shown at 29*b* receives the optional spring 34*a* (see FIGS. 3 and 15); the portion shown at 29*c* receives the ball 33*a* (FIG. 14); and the portion shown at 29*d* receives the valve seat 25*a*.

Figure 16:
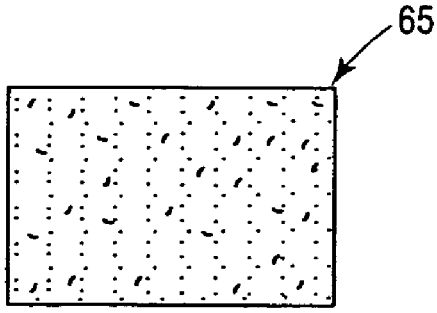
FIG. 16 is a side plan view of a fibrous filter element that may be used in place of the balls 33, 33*a* and optional springs 34, 34*a* on the embodiments shown in FIGS. 1 and 3.

In this alternative embodiment, the spring 34*a* is eliminated as the ball 33*a* tends to re-set against the retainer 25*a* when the flexible barrel 21*a* is released. Also, as another alternative, the ball 34*a* (or 34) may be replaced with a filter or buffer shown at 65 in FIG. 16. The filter or buffer 65 may be foam, a fibrous material or another porous material.

Figure 18:
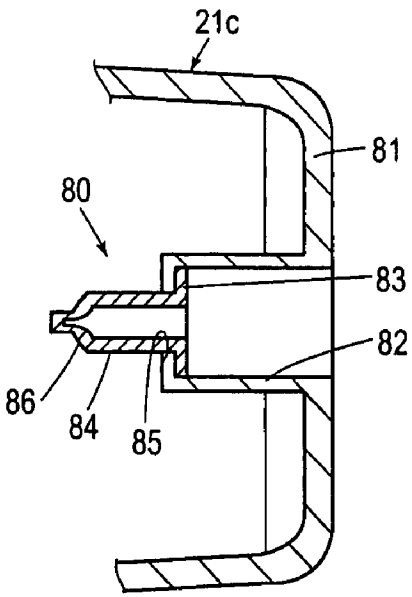
FIG. 18 is a partial sectional view of a barrel reservoir of the fluid dispensing instruments made in accordance with this disclosure, particularly illustrating the incorporation of a duck-bill valve for the introduction of air into the barrel.
Figure 17:
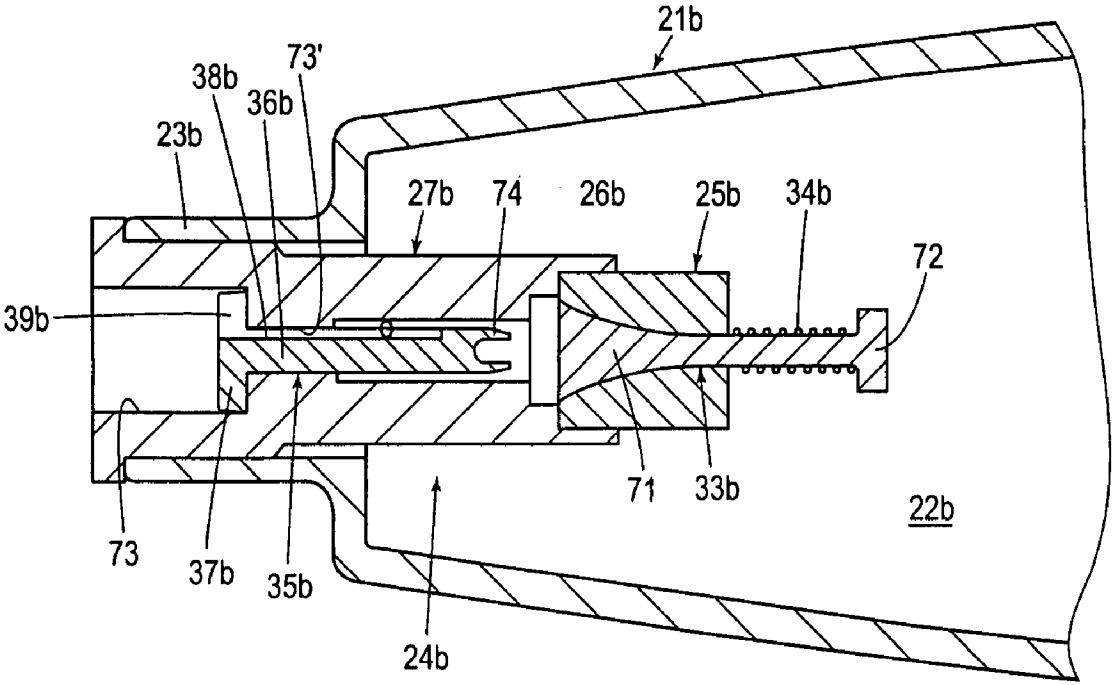
FIG. 17 is a partial sectional view of an alternative valve system for a fluid dispensing instrument, similar to those shown in FIGS. 1 and 3.

Turning to FIGS. 17-18, an alternative embodiment is disclosed whereby the barrel reservoir 21*b* is connected to a trumpet or needle valve assembly shown at 24*b*. The collar structure 27*b* of the trumpet valve assembly 24*b* is received within the collar 23*b* of the reservoir 21*b*. The proximal end 26*b* of the collar is connected to a shaped valve seat 25*b* for receiving the trumpet valve shown at 33*b*. The trumpet valve 33*b* includes a flared distal portion 71 and a flanged proximal end 72. A spring 34*b* is disposed between the flanged proximal end 72 of the trumpet valve 33*b* and the valve seat 25*b* and biases the valve 33*b* into the closed position as shown in FIG. 17. Internal pressure within the reservoir 22*b* generated by the user will cause the trumpet valve 33*b* to move in a distal direction (to the left in FIG. 17) and towards an open position (not shown). The collar 27*b* also includes a stepped central passageway shown at 73 that receives the distal end 71 of the trumpet valve 33*b* and the pin seal 35*b*. Similar to the pin seals 35 (FIGS. 1-2) and 35*b* (FIGS. 3 and 6-9) discussed above, the pin seal 35*b* includes a flanged end 37*b* and a shaft 36*b*.

Grooves or slots 38*b*, 39*b* are disposed within the shaft 36*b* and flange 37*b* to facilitate and control the transmission of fluid in the distal direction as discussed above with the other disclosed embodiments. The pin seal 35*b* is shown in an open position in FIG. 17 with the slots 38*b*, 39*b* permitting fluid flow past the pin seal 35*b*. In an initial closed position, the pin seal 35*b* would be moved to the left in FIG. 17 so the proximal end 74 of the shaft 36*b* would plug the narrowed portion 73' of the passageway 73. Further, in the open position shown in FIG. 17, the shaft 36*b* of the pin seal 35*b* includes a cupped or c-shaped proximal end 74 to further restrict or control fluid flowing through the open valve 24*b*.

FIG. 18 illustrates a duck-bill valve 80 that may be incorporated into a barrel reservoir such as that shown at 21*c*. Specifically, at a proximal end 81 of a barrel reservoir 21*c*, a recess 82 may be provided with a central opening for receiving a duck-bill valve 80. The flanged proximal portion 83 of the valve is received and secured within the recess 82 and a hollow shaft portion 84 of the valve 80 extends through an opening 85 in the recess. The hollow shaft 84 terminates at a duck-bill valve element 86 which will open when pressure is generated within the reservoir 21*c* to permit the flow of air through the valve 80 and into the reservoir 21*c*.

Figure 19:
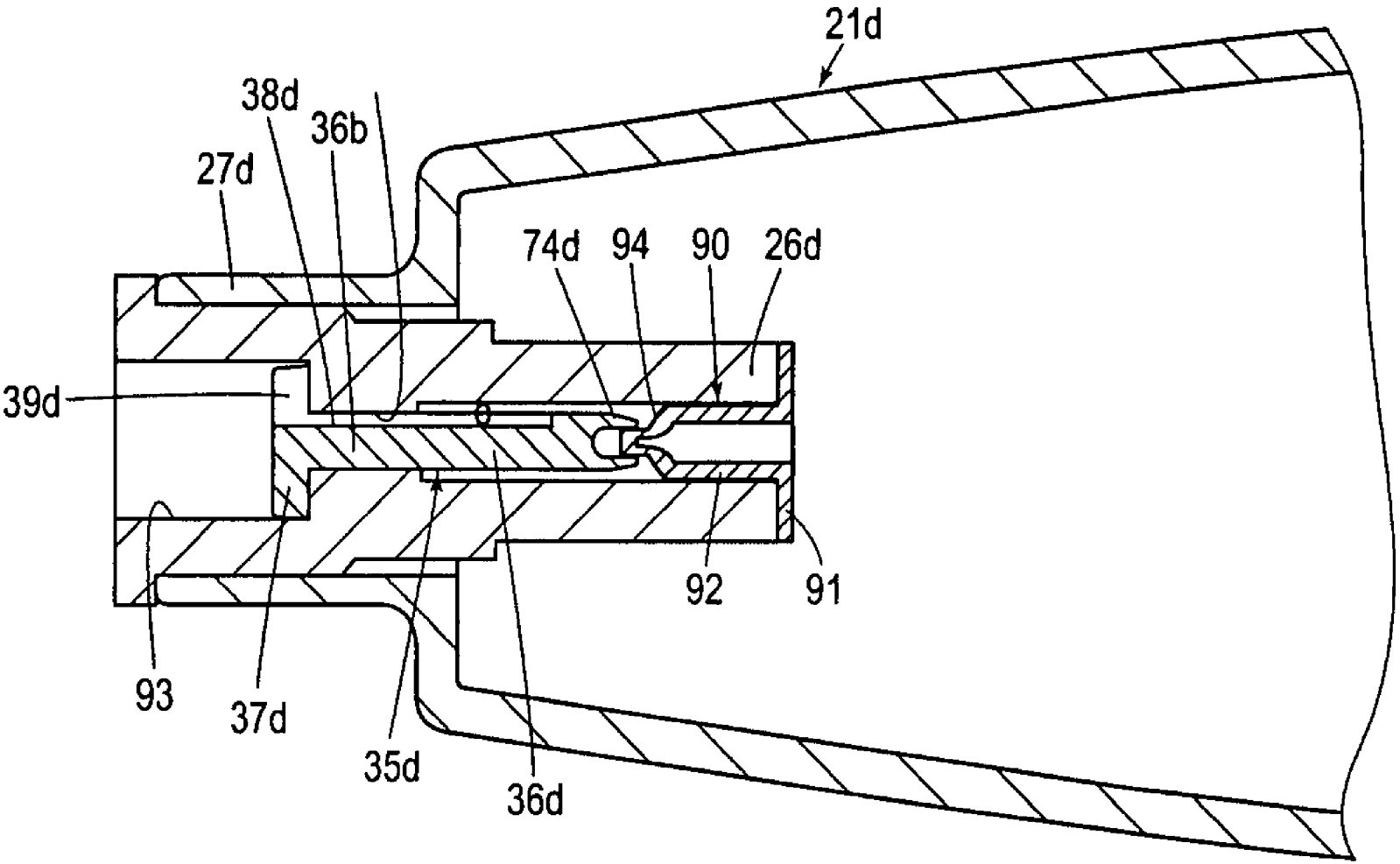
FIG. 19 is a partial sectional view of yet another alternative valve system for a fluid dispensing instrument, similar to those shown in FIGS. 1, 3 and 16.

Finally, FIG. 19 illustrates another duck-bill valve 90 that is used as a control valve for controlling flow of fluid between a barrel reservoir 21*d* and out through the collar 27*d*. Specifically, the proximal end 26*d* of the collar receives a duck-bill valve element 90 with the flanged portion 91 of the duck-bill valve 90 engaging the proximal end 26*d* of the collar 27*d*. The hollow shaft portion 92 of the duck-bill valve 90 is received within the stepped central passageway 93 and terminates at the duck-bill valve element shown at 94. Pressure within the barrel reservoir 21*d* causes the duck-bill valve element to open thereby permitting fluid to flow into the collar 27*d* and past the pin seal element 35*d*. The pin seal element 35*d* that includes a shaft portion 36*d* and a flange portion 37*d*. The shaft and flange portions 36*d*, 37*d* also include grooves shown at 38*d*, 39*d*, respectively. Finally, the shaft 36*d* of the pin seal 35*d* also includes the cupped or c-shaped end 74*d* for further controlling or restricting the flow of fluid passing through the collar 27*d* when the duck-bill valve element 94 is opened.

Those skilled in the art will recognize the remaining details of the duck-bill valves 80, 90 shown in FIGS. 18 and 19 and thus, the complete workings of the valves 80, 90 will not be recited again here.

While only certain embodiments have been set forth, alternative embodiments and various modifications will be apparent to those skilled in the art. These and other alternatives are considered equivalents and within the spirit and scope of this disclosure.

What is claimed is:

1. A liquid applicator comprising:

a flexible reservoir for accommodating liquid, the reservoir comprising an open end connected to a ferrule with a valve assembly disposed therebetween, the valve assembly comprising a collar comprising a proximal end facing the reservoir and a distal end facing the ferrule, the collar comprising a stepped passageway providing communication between the reservoir and the ferrule, the stepped passageway having a narrow middle portion between the proximal and distal ends of the collar, the proximal end of the collar receiving a valve member and a retainer with the valve member trapped between the retainer and the narrow middle portion of the collar; and the distal end of the collar receives a pin seal, the pin seal comprising a shaft comprising a solid proximal end directed towards the reservoir and a distal end directed towards the ferrule, the distal end of the shaft comprising an axial slot, the distal end of the shaft of the pin seal is connected to a flange that is accommodated in the distal end of the collar, wherein the pin seal is movable between a closed position with proximal end of the shaft being disposed in the narrow middle portion of the stepped passageway and blocking flow therethrough and an open position where at least a portion of the axial slot is disposed in the narrow middle portion of the stepped passageway thereby permitting restricted flow therethrough.

2. The liquid applicator of claim 1 wherein the valve member is biased against the retainer in a closed position and being spaced apart from the seat when the flexible reservoir is squeezed thereby increasing pressure within the reservoir to move the valve member to an open position.

3. The liquid applicator of claim 1 wherein the valve member is a ball.

4. The liquid applicator of claim 3 further comprising a spring trapped between the ball and the middle portion of the collar.

5. The liquid applicator of claim 1 wherein the valve member is a trumpet valve.

6. The liquid applicator of claim 5 wherein the trumpet valve comprises a flared distal end and flanged proximal end with a tapered middle portion disposed therebetween, the retainer comprising a distal end and a proximal end with a tapered passageway extending therethrough, the distal end of the retainer serving as a seat for the flared distal end of the trumpet valve, the middle portion of the trumpet valve passing through a spring that is trapped between the flanged proximal end of the trumpet valve and the proximal end of the retainer to bias the flared distal end of the trumpet valve against the distal end of the retainer.

7. The liquid applicator of claim 1 wherein the flange of the pin seal comprises a slot in alignment with the axial slot of the shaft.

8. The liquid applicator of claim 1 further comprising a restrictor element disposed between the ferrule and distal end of the collar.

9. The liquid applicator of claim 1 further comprising a permeable tuft element disposed between the ferrule and distal end of the collar.

10. The liquid applicator of claim 9 further comprising a restrictor element disposed between the permeable tuft element and distal end of the collar.

11. The liquid applicator of claim 1 wherein the applicator is a paint or ink brush.

12. The liquid applicator of claim 1 wherein the solid proximal end of the pin seal cooperates with the collar to close the stepped passageway.

13. A paint or ink brush comprising:

a flexible reservoir for accommodating paint or ink, the reservoir comprising an open end connected to a ferrule with a valve assembly and a tufted brush element disposed therebetween, the valve assembly comprising a collar comprising a proximal end facing the reservoir and a distal end facing the ferrule, the collar comprising a stepped passageway providing communication between the reservoir and the ferrule, the stepped passageway having a narrow middle portion between the proximal and distal ends of the collar, the proximal end of the collar receiving a valve member and a retainer with the valve member trapped between the retainer and the middle portion of the collar, the valve member being biased against the seat in a closed position and being spaced apart from the retainer when the flexible reservoir is squeezed thereby increasing pressure within the reservoir to move the valve member to an open position, the distal end of the collar receives a pin seal, the pin seal comprising a shaft comprising a solid proximal end directed towards the reservoir and a distal end directed towards the ferrule, the distal end of the shaft comprising an axial slot, wherein the valve member comprises a permeable body.

14. The paint or ink brush of claim 13 wherein the permeable body is a fibrous body or a foam body.

15. The paint or ink brush of claim 13 wherein the valve member is a trumpet valve.

16. The paint or ink brush of claim 15 wherein the trumpet valve comprises a flared distal end and flanged proximal end with a tapered middle portion disposed therebetween, the retainer comprising a distal end and a proximal end with a tapered passageway extending therethrough, the distal end of the retainer serving as a seat for the flared distal end of the trumpet valve, the middle portion of the trumpet valve passing through a spring that is trapped between the flanged proximal end of the trumpet valve and the proximal end of the retainer to bias the flared distal end of the trumpet valve against the distal end of the retainer.

17. The paint or ink brush of claim 13 wherein the distal end of the shaft of the pin seal is connected to a flange that is accommodated in the distal end of the collar.

18. The paint or ink brush of claim 17 wherein the flange of the pin seal comprises a slot in alignment with the axial slot of the shaft.

19. The paint or ink brush of claim 13 further comprising a restrictor element disposed between the tufted brush element and distal end of the collar.

20. A paint or ink brush comprising:

a flexible reservoir for accommodating paint or ink, the reservoir comprising an open end connected to a ferrule with a valve assembly and a tufted brush element disposed therebetween, the valve assembly comprising a collar comprising a proximal end facing the reservoir and a distal end facing the ferrule, the collar comprising a stepped passageway providing communication between the reservoir and the ferrule, the stepped passageway having a narrow middle portion between the proximal and distal ends of the collar, the proximal end of the collar receiving a permeable valve member, the distal end of the collar receives a pin seal, the pin seal comprising a shaft comprising a solid proximal end directed towards the reservoir and a distal end directed towards the ferrule, the distal end of the shaft comprising an axial slot, the tufted brush element being disposed between the valve assembly and the ferrule.

21. The paint or ink brush of claim 20 wherein the distal end of the collar receiving a pin seal, the pin seal comprising a shaft comprising a solid proximal end directed towards the reservoir and a distal end directed towards the ferrule, and the distal end of the shaft comprising an axial slot, the pin seal being movable between a closed position with proximal end of the shaft being disposed in the middle portion of the collar and blocking flow therethrough and an open position where at least a portion of the axial slot is disposed in the middle portion of the collar thereby permitting restricted flow therethrough.

22. The paint or ink brush of claim 21 wherein the distal end of the shaft of the pin seal is connected to a flange that is accommodated in the distal end of the collar.

23. The paint or ink brush of claim 22 wherein the flange of the pin seal comprises a slot in alignment with the axial slot of the shaft.

24. The paint or ink brush of claim 20 further comprising a retainer received in the proximal end of the collar the traps the permeable valve member between the middle portion of the passageway of the collar and the retainer.

25. The paint or ink brush of claim 20 wherein the permeable valve member is a fibrous body or a foam body.

26. The paint or ink brush of claim 20 further comprising a restrictor element disposed between the tufted brush element and distal end of the collar.

* * * * *

UNITED STATES PATENT AND TRADEMARK OFFICE

CERTIFICATE OF CORRECTION

PATENT NO. : 7,467,907 B2
APPLICATION NO. : 10/896560
DATED : December 23, 2008
INVENTOR(S) : Steven Gaynes et al.

It is certified that error appears in the above-identified patent and that said Letters Patent is hereby corrected as shown below:

On the Cover Page:

Item (75), first Inventor, "Steven Gaynes, Wonderlake, IL" should be -- Stephen Gaynes, McHenry, IL --.

Item (75), fourth Inventor, "Michael Flader, Vernon Hills, IL" should be -- Michael Flader, West Dundee, IL --.

Item (75), fifth Inventor, "Jason Cantu, Vernon Hills, IL" should be -- Jason Cantu, Downers Grove, IL --.

In the Claims:

At Column 10, line 12, "the traps" should be -- that traps --.

Signed and Sealed this

Thirtieth Day of June, 2009

John Doll

JOHN DOLL
*Acting Director of the United States Patent and Trademark Office*